US007954937B2

(12) United States Patent
Inamura et al.

(10) Patent No.: US 7,954,937 B2
(45) Date of Patent: Jun. 7, 2011

(54) INK JET PRINTING APPARATUS

(75) Inventors: Shusuke Inamura, Hino (JP); Takashi Horiba, Kawasaki (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 12/877,923

(22) Filed: Sep. 8, 2010

(65) Prior Publication Data

US 2010/0328406 A1 Dec. 30, 2010

Related U.S. Application Data

(62) Division of application No. 11/840,681, filed on Aug. 17, 2007, now Pat. No. 7,815,288.

(30) Foreign Application Priority Data

Aug. 23, 2006 (JP) ..... 2006-227183

(51) Int. Cl.
*B41J 2/175* (2006.01)

(52) U.S. Cl. ..... 347/87; 347/49; 347/50; 347/84; 347/85; 347/86

(58) Field of Classification Search ..... 347/49, 347/50, 86, 87
See application file for complete search history.

(56) References Cited

U.S. PATENT DOCUMENTS

| | | | | |
|---|---|---|---|---|
| 5,619,237 | A | 4/1997 | Inoue et al. | 347/86 |
| 5,748,210 | A | 5/1998 | Watanabe et al. | 347/50 |
| 5,936,740 | A | 8/1999 | Fukazawa et al. | 358/296 |
| 6,336,709 | B1 | 1/2002 | Inoue et al. | 347/49 |
| 6,623,105 | B1 | 9/2003 | Shen | 347/49 |
| 6,663,233 | B2 | 12/2003 | Otsuka et al. | 347/85 |
| 6,685,308 | B2 | 2/2004 | Yoshida et al. | 347/85 |
| 6,783,215 | B2 | 8/2004 | Yoshida et al. | 347/85 |
| 6,799,840 | B2 | 10/2004 | Inamura | 347/85 |
| 6,837,921 | B2 | 1/2005 | Inoue et al. | 96/6 |
| 6,948,803 | B2 | 9/2005 | Yoshida et al. | 347/85 |
| 7,101,019 | B2 | 9/2006 | Inoue et al. | 347/37 |
| 2003/0007023 | A1 | 1/2003 | Barclay et al. | 347/8 |
| 2004/0183858 | A1 * | 9/2004 | Inoue et al. | 347/49 |

FOREIGN PATENT DOCUMENTS

JP 2004-090343 3/2004

* cited by examiner

*Primary Examiner* — Ryan Lepisto
(74) *Attorney, Agent, or Firm* — Fitzpatrick, Cella, Harper & Scinto

(57) ABSTRACT

The present invention provides an ink jet printing apparatus capable of improving reliability of an electrical connecting portion between a carriage side and head cartridge side. When an ink tank is mounted on a head cartridge, a hook of a set lever is obstructed to be operated in a lock releasing direction by a restricting surface of the ink tank. This prevents the head cartridge from being removed from the carriage, and maintains an electrical connecting condition between the carriage and the head cartridge. Therefore, for removing the head cartridge, it is necessary to remove the ink tank.

9 Claims, 18 Drawing Sheets

INK JET PRINTING APPARATUS

This application is a division of application Ser. No. 11/840,681, filed Aug. 17, 2007, the contents of which are incorporated herein by reference.

BACKGROUND OF THE INVENTION

1. Field of the Invention

The present invention relates to an ink jet printing apparatus on which a head cartridge equipped with a printing head is mounted to be detachable with respect to a carriage, and an ink tank is mounted to be replaceable with respect to the head cartridge.

2. Description of the Related Art

As a printing apparatus, there is a printing apparatus having functions such as printing, copying, facsimiling or the like, or a printing apparatus used for an outputting apparatus of complex electronic hardware including a computer, word processor or the like, and a printing apparatus used for an outputting apparatus of a workstation. Such a printing apparatus is constructed so that it can print an image on printing material (printing medium) such as paper, plastic thin plates or the like based on image information.

And, the printing apparatus can be classified as an ink jet method, a wire dot method, a thermal method, a laser beam method or the like depending on its printing method. Among these, since the inkjet method, in particular, can make a printing image high in image quality, and realize a low running cost, it has become widely popular in general households in recent years. In conjunction with this, it has been demanded that the printing apparatus is to be downsized and light in weight. Normally, the printing head of the printing apparatus of a popular type ink jet method (ink jet printing apparatus) like this is mounted to be detachable on a head mounting portion (in a serial scan type printing apparatus, carriage) of the printing apparatus for maintenance or the like. A detachable mechanism serving as the printing head in the head mounting portion is required to be easily detachable in construction limiting mistakes by the user as much as possible.

Japanese Patent Laid-Open No. 2004-090343 discloses an ink jet printing apparatus of a serial scan type on which the head cartridge equipped with the printing head is mounted to be detachable with respect to a carriage, furthermore, an ink tank is mounted to be replaceable with respect to the head cartridge. The carriage is equipped with a lever which is operated when attaching/removing the head cartridge. After mounting of the head cartridge on the carriage, by operating the lever in one direction, the head cartridge is fixed to the carriage, and a contact of a head cartridge side is pressed to a contact of carriage side, therefore, they are electrically connected. By operating the lever in the other direction, the contact of the head cartridge side is released from the contact of the carriage side, and the head cartridge can be removed from the carriage.

However, in the printing apparatus constructed like this, when removing the ink tank from the head cartridge, users may operate the lever by mistake to induce the head cartridge to be removed from the carriage. In comparison with a replacement frequency of the ink tank, a replacement frequency of the head cartridge is extremely low. And, when removing the head cartridge from the carriage, the printing head equipped on the head cartridge may be damaged during performance by environmental changes and contact with peripherals.

From such a point of view, some printing apparatuses, in recent years, have constructions equipped to limit operation of the lever in the other direction so that the lever cannot be completely operated in the other direction unless the ink tank is removed from the head cartridge. Unless the lever can be completely operated in the other direction, although a pressing force of the contact of the head cartridge side with respect to the contact of the carriage side loosens, the head cartridge cannot be removed. By enabling a detachment of the head cartridge as a condition for removing the ink tank like this, a situation in which users can remove the head cartridge by mistake can be avoided in advance.

However, when limiting the operation of the lever in the other direction as mentioned above, although the head cartridge cannot be removed, the pressing force of the contact of the head cartridge with respect to the contact of the carriage side becomes loose. Therefore, because those contacts separate, they may not be maintained in an electrically conductive state.

Since a contact between the carriage side and the head cartridge side is important so as to transmit a drive signal of the printing head or the like, those contacts, therefore, are preferably prevented from wear by maintaining the electrically conductive state.

SUMMARY OF THE INVENTION

The present invention provides an ink jet printing apparatus which can improve an electrical reliability of the contact portion of the carriage side and head cartridge side.

There is provided an ink jet printing apparatus capable of printing an image on a printing medium with a movement of a carriage on which a head cartridge is mounted to be detachable, the head cartridge being mounted with an ink tank to be replaceable and being equipped with a printing head capable of ejecting ink supplied from the ink tank, comprising: a carriage side connecting portion, which is provided in the carriage, forming a transmission route of control signal of the printing head, and being connected by pressure contact with a head cartridge side connecting portion provided in the head cartridge; pressure contact means for connecting the head cartridge side connecting portion and the carriage side connecting portion by pressure contact when the head cartridge is mounted on the carriage; locking means for fixing the head cartridge to the carriage when the head cartridge is mounted on the carriage, and releasing a fixation of the head cartridge by receiving a releasing operation; and obstructing means for obstructing the releasing operation of the locking means while maintaining a connection between the head cartridge side connecting portion and the carriage side connecting portion by the pressure contact means when the ink tank is mounted on the head cartridge, and for enabling the releasing operation of the locking means when the ink tank is not mounted on the head cartridge.

According to the present invention, when the ink tank is mounted on the head cartridge, the head cartridge is prevented from being removed from the carriage, and the carriage and the head cartridge are maintained in an electrically conductive state simultaneously. Therefore, it is necessary to remove the ink tank in order to remove the head cartridge. Accordingly, when replacing the head cartridge, users may not remove the head cartridge by mistake, and unnecessary contact and separation of the electrical connecting portion between the carriage and the head cartridge can be prevented. As a result, electrical reliability of the connecting portion can be improved.

Further features of the present invention will become apparent from the following description of exemplary embodiments (with reference to the attached drawings).

DESCRIPTION OF THE EMBODIMENTS

Embodiments of the present invention are described in detail with reference to the drawings.

Figure 1:
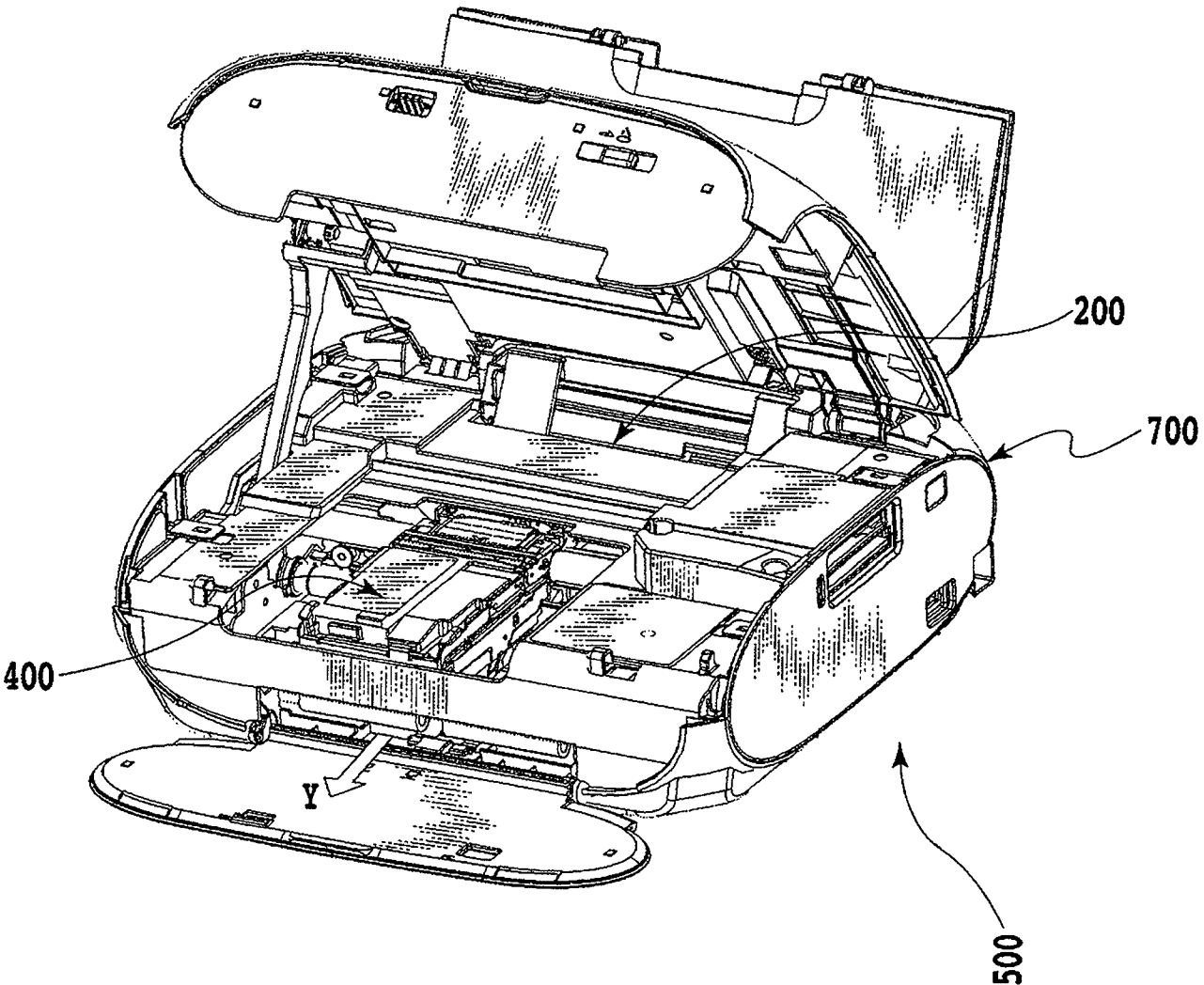
FIG. 1 is a perspective view in a condition with a cover open in a printing apparatus according to a preferred embodiment of the present invention.
Figure 2:
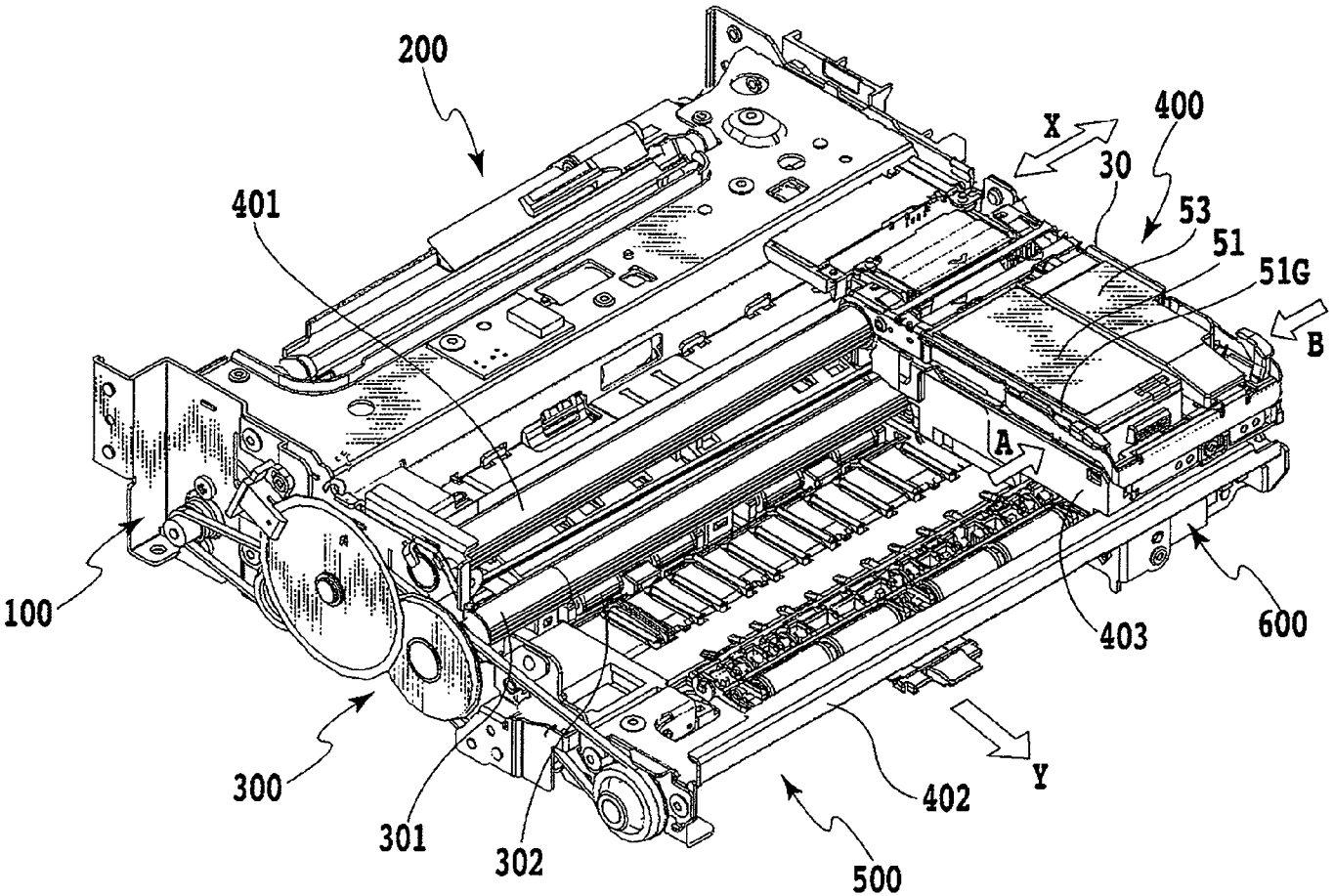
FIG. 2 is a perspective view of an internal mechanism in the printing apparatus of FIG. 1.
Figure 3:
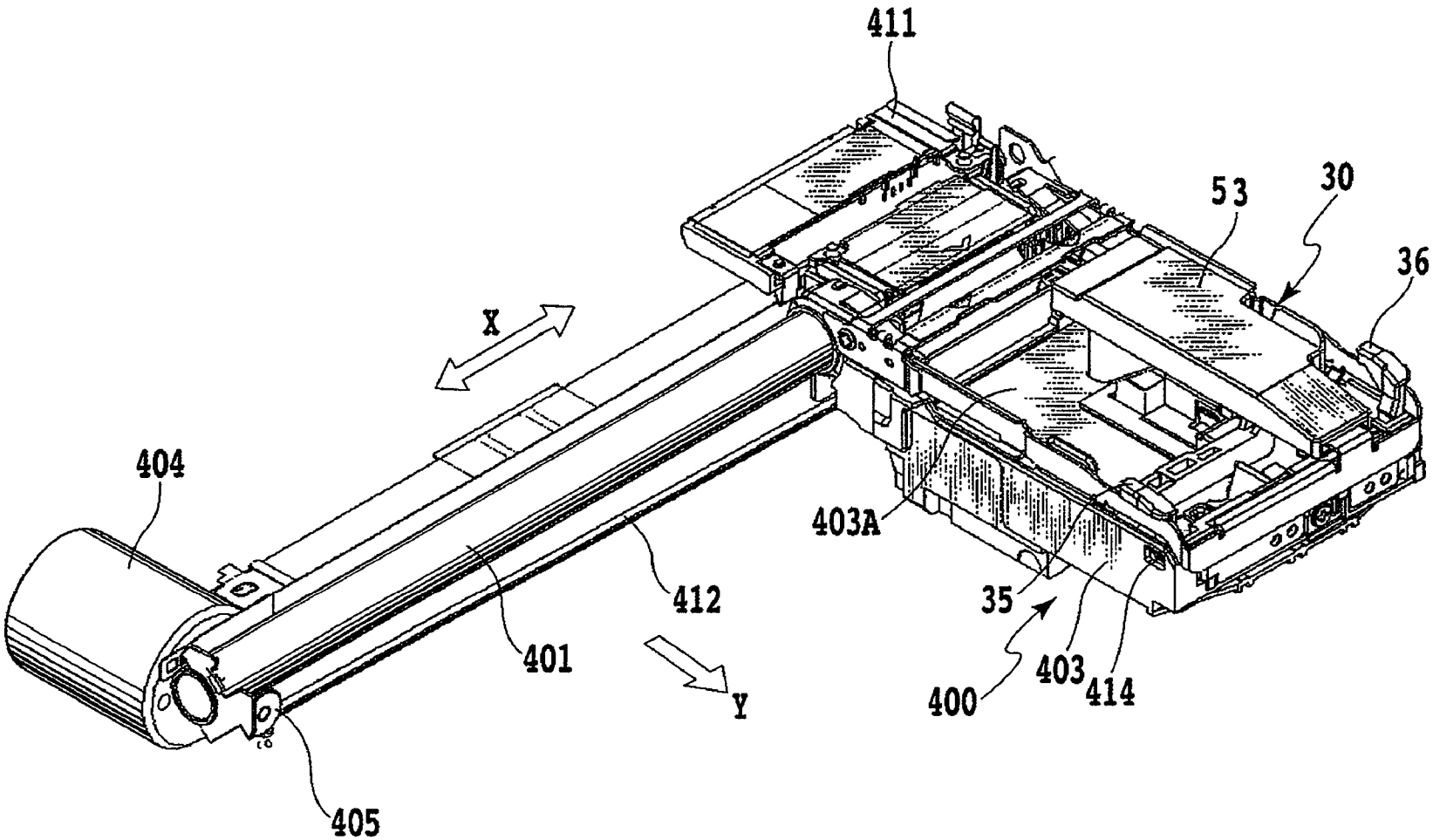
FIG. 3 is a perspective view of a carriage portion in the internal mechanism of FIG. 2.

FIG. 1 is a perspective view in a condition with a cover open in a printing apparatus according to a preferred embodiment of the present invention, FIG. 2 is a perspective view of an internal mechanism, and FIG. 3 is a perspective view of a carriage portion. In these drawings, 100 is a chassis portion of a printer unit; 200 is a paper supplying portion; 300 is a paper feeding portion; 400 is a carriage portion on which a printing head and an ink tank can be loaded; and 500 is a discharging portion. And, 600 is a recovering portion performing maintenance of the printing head, and 700 is a cover portion covering the printing apparatus. In the rear of a paper supplying portion 200, a printed board (not shown) for performing a control of a printing apparatus main body is arranged.

Figure 6:
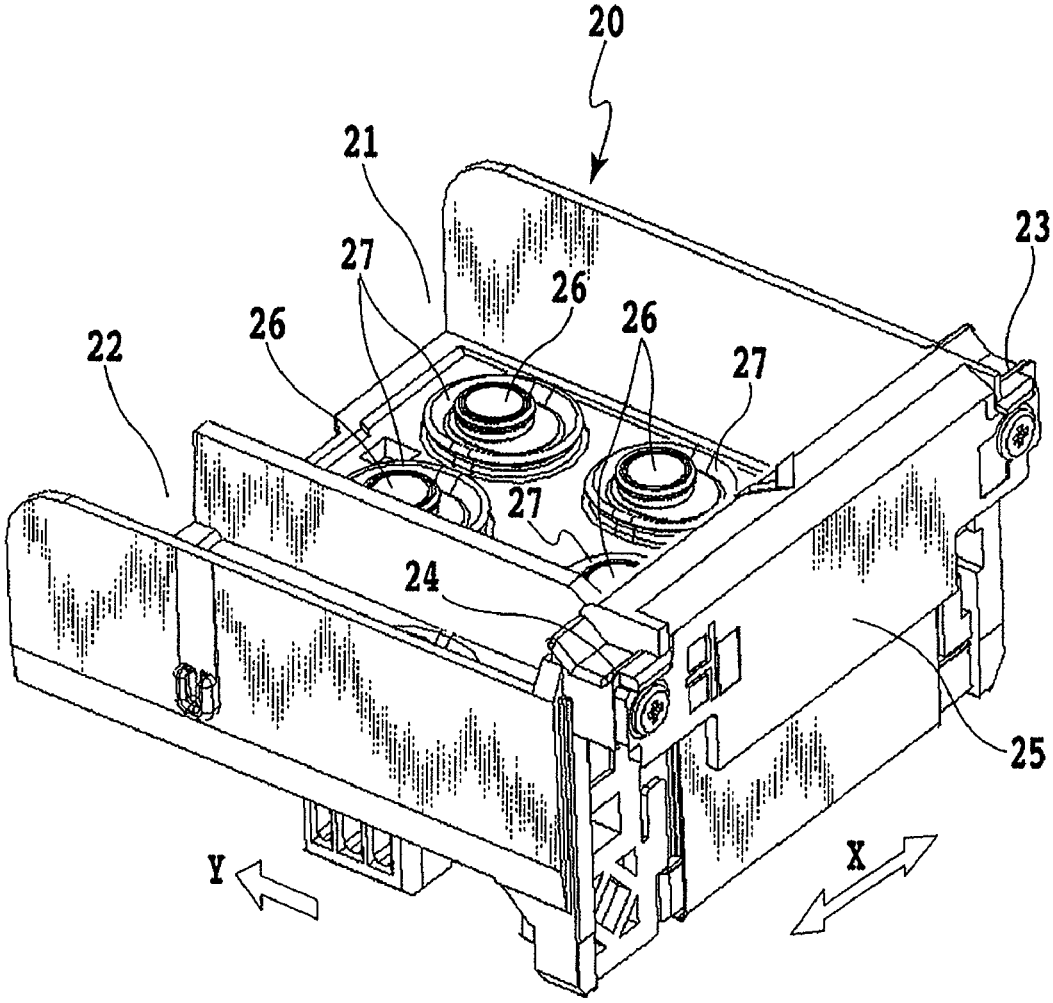
FIG. 6 is a perspective view of a head cartridge mountable on the carriage in FIG. 3.

A carriage 403 is guided to be movable in a main scan direction of an arrow X by a guide shaft 401 and a guide rail 402 which are fixed at both ends to the chassis portion 100. The main scan direction is a direction crossing (in the present example, orthogonally) a sub-scan direction of an arrow Y in which a printing medium is transported. On the carriage 403, a head cartridge 20 (refer to FIG. 6) is mounted to be detachable. Between a drive pulley 405 fixed on an output shaft of a carriage drive motor 404 and a driven pulley 44 (not shown) axially supported to be rotatable, a drive belt 412 is extended, and the drive belt 412 is connected to the carriage 403. Therefore, by driving the carriage drive motor 404, via the drive belt 405, the carriage 403 is reciprocally moved in the main scan direction.

A paper feeding portion 300 transports the printing medium in the sub-scan direction of the arrow Y by holding/sandwiching the printing medium with an LF roller 301 driven by an LF drive motor (not shown) and a pinch roller 302 located beneath the LF roller 301.

Figure 7:
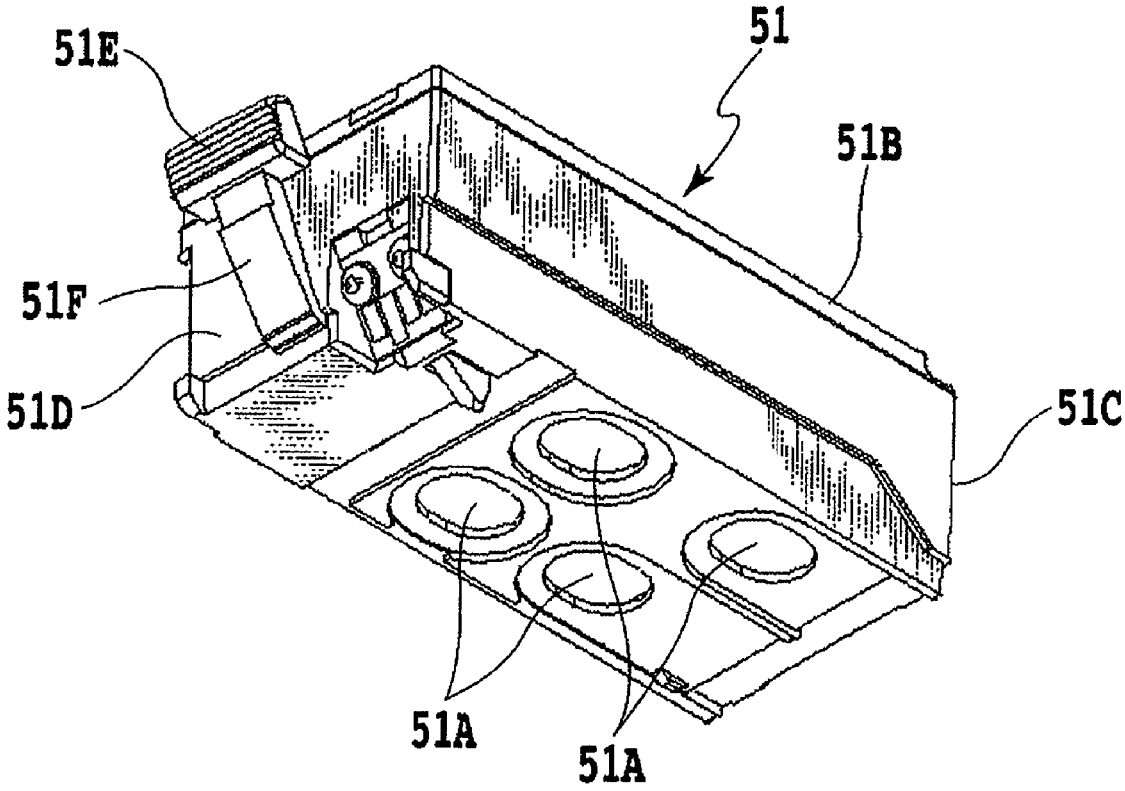
FIG. 7 is a perspective view of an ink tank mountable on the head cartridge in FIG. 6.

In the printing head equipped on a head cartridge 20 of the present example, an ejecting portion capable of ejecting inks of yellow (Y), magenta (M), cyan (C), and photo black (Bk) is formed. And, in the head cartridge 20, ink tank holders 21 and 22 are formed. With respect to the ink tank holder 21, a color ink tank 51 (refer to FIG. 7) housing the inks of Y, M, C, and Bk is mounted to be replaceable. And, with respect to the ink tank holder 22, a black ink tank 52 (refer to FIG. 11) housing pigment black ink is mounted to be replaceable. When the printing head for ejecting the ink in the ink tanks 51, 52 is equipped in the head cartridge 20, the ink tanks 51, 52 are mounted on the holders 21, 22, respectively. In the case of the present example, the printing head for ejecting the ink in the ink tank 51 is equipped. Therefore, instead of mounting the ink tank 52, a tank cover 53 is mounted on a set lever 30 as mentioned later.

Figure 4:
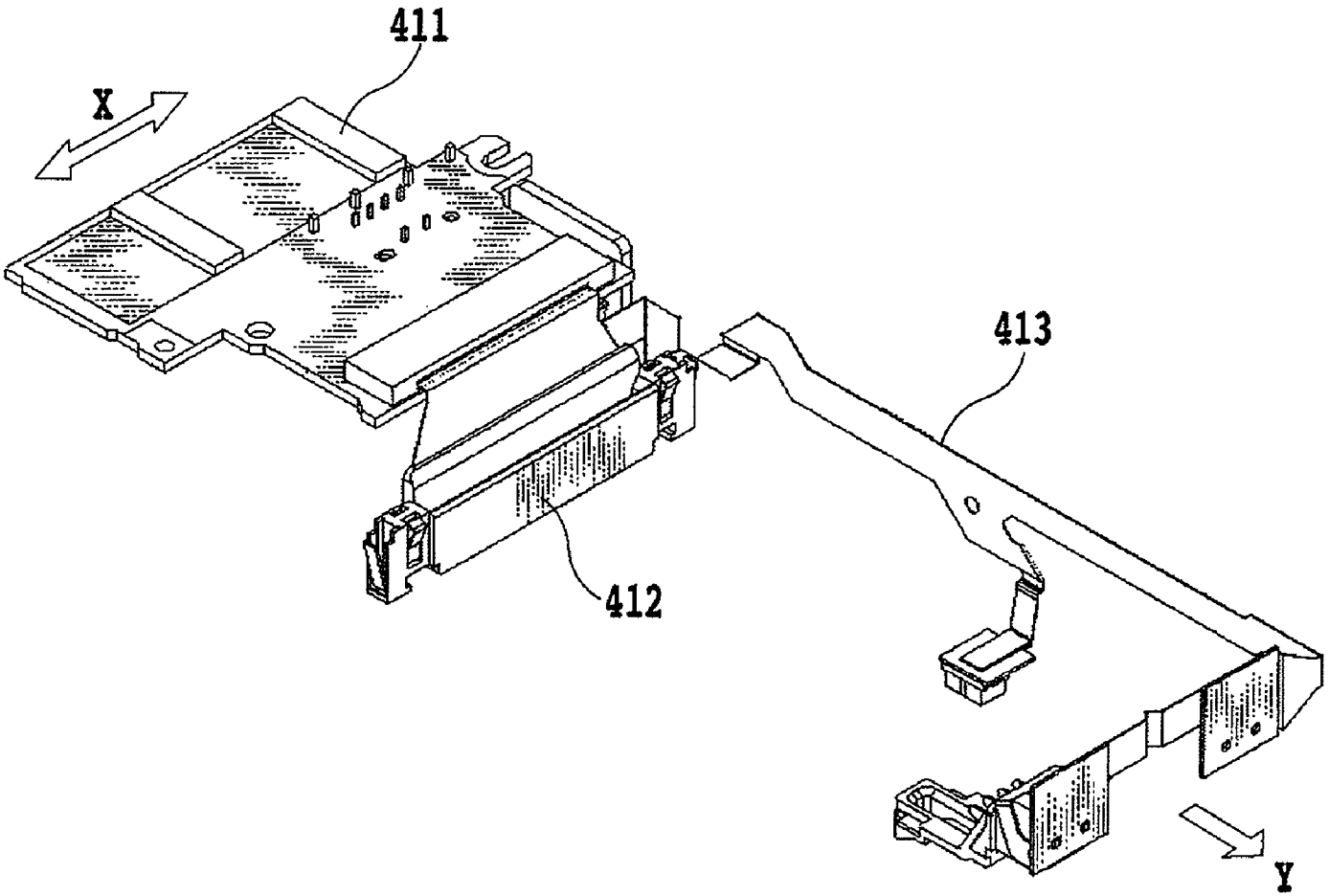
FIG. 4 is a perspective view of a wiring portion built into the carriage in FIG. 3.

A drive signal of the printing head is transmitted from a control board (not shown) of the ink jet printing apparatus to a flexible cable (not shown), a cable connector of the carriage 403 and a cartridge connector 412 (refer to FIG. 4). The cartridge connector 412 is a card edge connector, and equipped in the carriage 403 via an elastic member. By means of the elastic member, a contact pressure between the cartridge connector 412 and a contact board 25 mentioned later is secured. The cable connector 411 and the cartridge connector 412 are assembled to the carriage 403 together with a metal plate 413. The drive signal of the printing head is transmitted to the printing head via the contact board 25 (refer to FIG. 6) of the head cartridge 20 side. Based on the drive signal, the ink is ejected from the ejecting portion of the printing head.

Figure 8B:
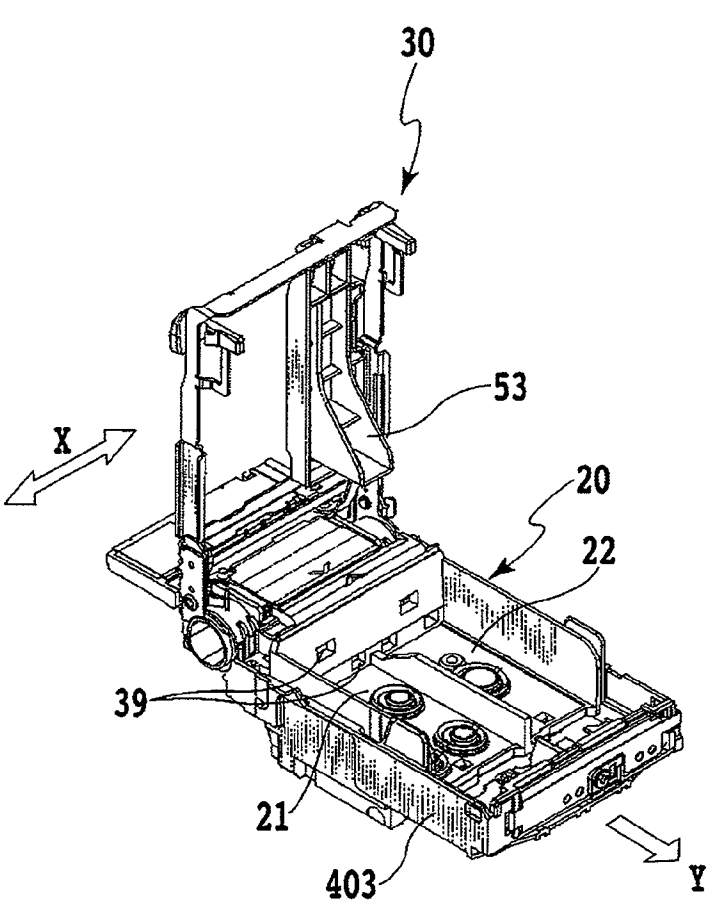
FIG. 8A and FIG. 8B are explanatory drawings of a mounting work of the head cartridge with respect to the carriage in FIG. 3, respectively.
Figure 8A:
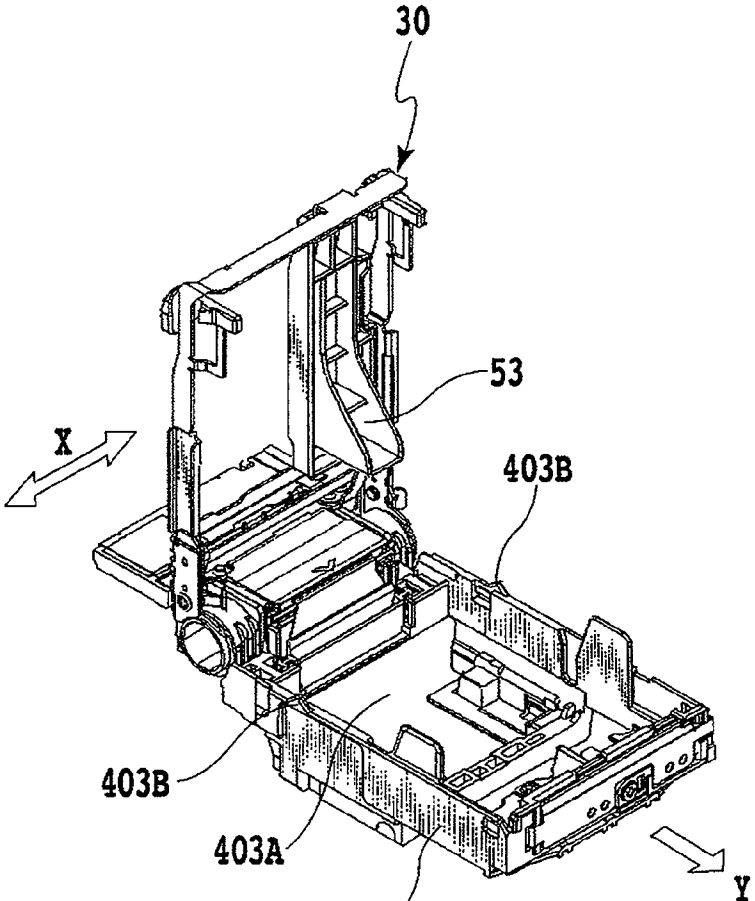

In the carriage 403, as shown in FIG. 3 and FIG. 8A, an opening 403A for housing the head cartridge 20 is formed. As shown in FIG. 8B, the head cartridge 20 can be inserted from an upper side direction with respect to the opening 403A. In right/left bearing portions of the carriage 403 fitted to be slidable in the shaft 401, axial holes portions 31, 32 (refer to FIG. 5) of the base side of the set lever 30 are fitted in to be rotatable. As shown in FIG. 8B, when the head cartridge 20 is mounted, the set lever 30 is rotated so as to locate at an upper side evacuation position. And, after having mounted the head cartridge 20, the head cartridge 20 is fixed to the carriage 403 in such a manner that the set lever 30 is rotated downward as shown in FIG. 9A.

Figure 5:
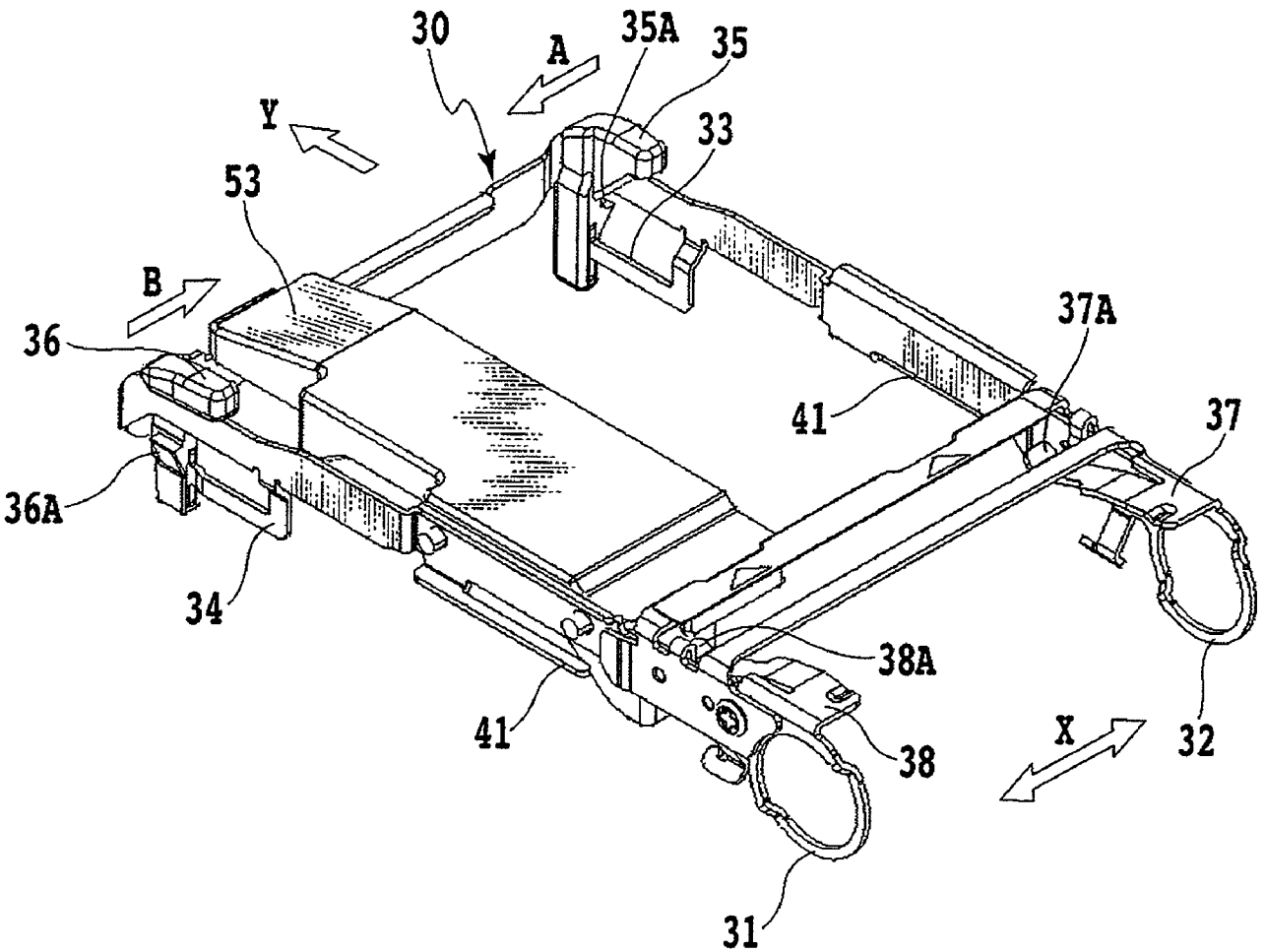
FIG. 5 is a perspective view of a set lever in FIG. 3.

The set lever 30 is formed by a metal plate as shown in FIG. 5, and in right/left portions 33, 34 of the tip side, resin-made right/left head set hooks 35, 36 operated in arrows A, B directions by users are fixed by press fitting. In those hooks 35, 36, claw portions 35A, 36A engageable with right/left locking holes 414, 414 (in FIG. 3, right side locking hole 414 is not shown) of the carriage 403 are formed. In the right/left rotation center vicinity of the set lever 30, right/left spring portions 37, 38 formed by another metal plate are fixed with screws. Tips 37A, 38A of those spring portions 37, 38 are bent upward. When the contact board 25 of the head cartridge 20 side is pressed to the connector 412 (refer to FIG. 4) of the carriage 403 side in such a manner that those tips 37A, 38A press right/left sloping surfaces 23, 24 (refer to FIG. 6) of the head cartridge 20, they are electrically connected. And, in right/left bottom tips of the set lever 30, a pop-up spring portion 41 is formed. When the set lever 30 is rotated downward, the pop-up spring portion 41 is deformed by a concave portion 403B of the carriage 403 side. And, when the lock of the set lever 30 is released as mentioned later, the set lever 30 is flipped upward by an elastic restoring force of the pop-up spring portion 41.

In the set lever 30 of the present example, a tank cover 53 is attached so that it may cover a holder 22 of the head cartridge 20 on which the black ink tank 52 (refer to FIG. 11) can be mounted. This prevents the black ink tank 52 from being mounted. When the black ink tank 52 is required to be mounted, the tank cover 53 is removed.

In a bottom surface of the color ink tank 51 (refer to FIG. 7) housing the inks of Y, M, C, and Bk, 4 supply ports 51A for supplying those inks are formed. When the ink tank 51 is mounted on the head cartridge 20, those supply ports 51A are connected to corresponding ink supplying pipes 26 (refer to FIG. 6) of the head cartridge side. Sealing material 27 is arranged around the ink supplying pipes 26, and the sealing material 27 is pressed when the ink tank 51 is mounted. This prevents the ink from leaking, and applies an upward urging force with respect to the ink tank 51.

Figure 10:
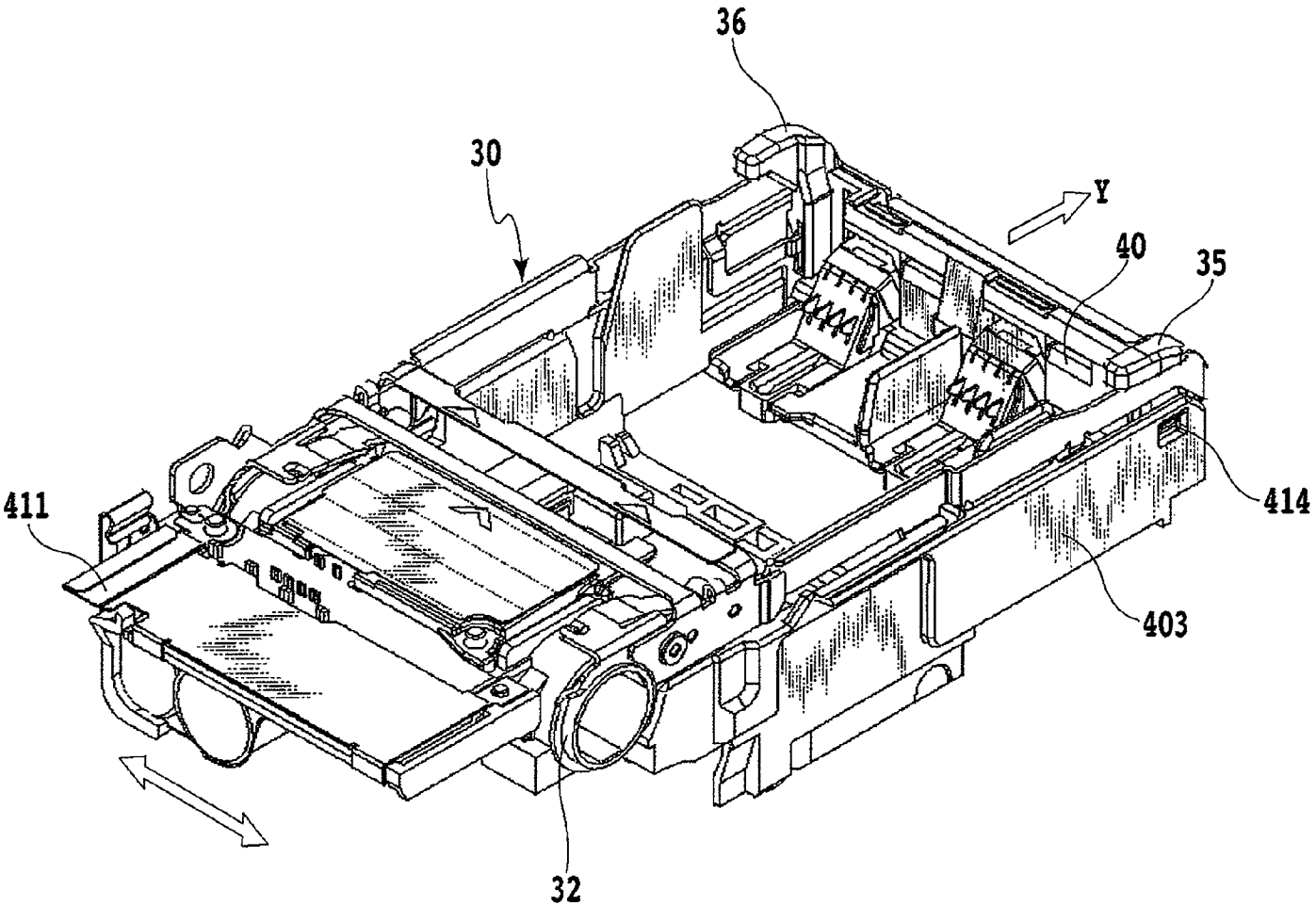
FIG. 10 is a perspective view when the carriage in FIG. 3 is constructed so that two ink tanks can be mounted.

The ink tank 51 is equipped with an upper cover 51B as a lid member sealing the ink tank by covering an upper portion of housing space of the ink, and in the upper cover 51B, an atmosphere communicating opening (not shown) is formed. And, in a surface 51C (refer to FIG. 7) of one end side of the ink tank 51, a retaining claw (not shown) which is engageable with a retaining hole 39 (refer to FIG. 8B) of the head cartridge 20 side is formed. Furthermore, in a surface 51D (refer to FIG. 7) of the other end side of the ink tank 51, a latch lever 51E elastically deformable is integrally formed. For the latch lever 51E, a latch claw 51F engageable with an engaging hole 40 (refer to FIG. 10) of the head cartridge 30 side is formed.

At an upper portion of the left side surface of the ink tank 51, a restricting surface 51G (refer to FIG. 9B) for restricting an operation of a left side hook 35 is formed. When the ink tank 51 has been mounted, the restricting surface 51G is located inside the hook 35 as shown in FIG. 2 so as to prevent the hook 35 from being operated in an arrow A direction. That is, when the ink tank 51 is mounted, the hook 35 cannot be operated in the arrow A direction.

On the other hand, for the tank cover 53, a surface equivalent to the restricting surface 51G of the ink tank 51 is not formed. That is, for the tank cover 53, a restricting surface for preventing a right side hook 36 from being operated in an arrow B direction is not formed. Therefore, the right side hook 36 can be operated in the arrow B direction regardless of whether the tank cover 53 is attached, and this can make engagement between a right side claw portion 36A and the locking hole 414 disengage at any time. However, even when an engagement of the right side claw portion 36A is released like this, the set lever cannot be rotated upward by releasing a lock of the set lever 30 unless the left side claw portion 35A has been released by operating the left side hook 35 in the arrow A direction. That is, when the ink tank 51 is mounted, the set lever cannot be rotated upward by releasing the set lever 30 from a locked state. Accordingly, since the head cartridge 20 cannot be removed, a contact pressure between a contact board 25 of the head cartridge 20 side and a connector 412 of the carriage 403 side is kept, and they are maintained in an electrical connecting state.

(Operation of Attaching the Head Cartridge)

Next, an operation of attaching the head cartridge 30 is explained.

When the head cartridge 20 is attached, after rotating the set lever 30 upward as shown in FIG. 8A, the head cartridge 20 is inserted inside an opening 403A of the carriage 403 as shown in FIG. 8B. After that, by rotating the set lever 30 downward as shown in FIG. 9A, the claw portions 45A, 36A of the right/left hooks 35, 36 are engaged with the locking holes 414, 414 of the carriage 403 side, respectively. This allows the head cartridge 30 to be fixed to the carriage 403 in such a manner that the set lever 30 is locked. At that time, as mentioned above, the tips 37A, 38A of the spring portions 37, 38 press the right/left sloping surfaces 23, 24 (refer to FIG. 6) of the head cartridge 20. This allows the contact board 25 of the head cartridge 20 side to be pressed to the connector 412 (refer to FIG. 4) of the carriage 403 side, and they are electrically connected.

(Operation of Removing the Head Cartridge)

As shown in FIG. 9A, when the ink tank 51 is not mounted, by operating the right/left hooks 35, 36 in the arrows A, B directions, the engagement between those claw portions 45A, 36A and the locking holes 414, 414 of the carriage 403 side can be released. This allows the lock of the set lever 30 to be released, and at that time, the set lever 30 is flipped upward by the elastic restoring force of the pop-up spring portion 41. And, by rotating the head cartridge 20 upward as shown in FIG. 8B, the head cartridge 20 can be removed.

And, when the ink tank 51 is mounted as shown in FIG. 2, the left side hook 35 is prevented from being operated in the arrow A direction. Therefore, the set lever 30 cannot be released from a locked state as mentioned above, and the head cartridge 20 cannot be removed. That is, when the head cartridge 20 is required to be removed, the ink tank 51 only has to be removed.

(Operation of Attaching the Ink Tank)

Figure 9B:
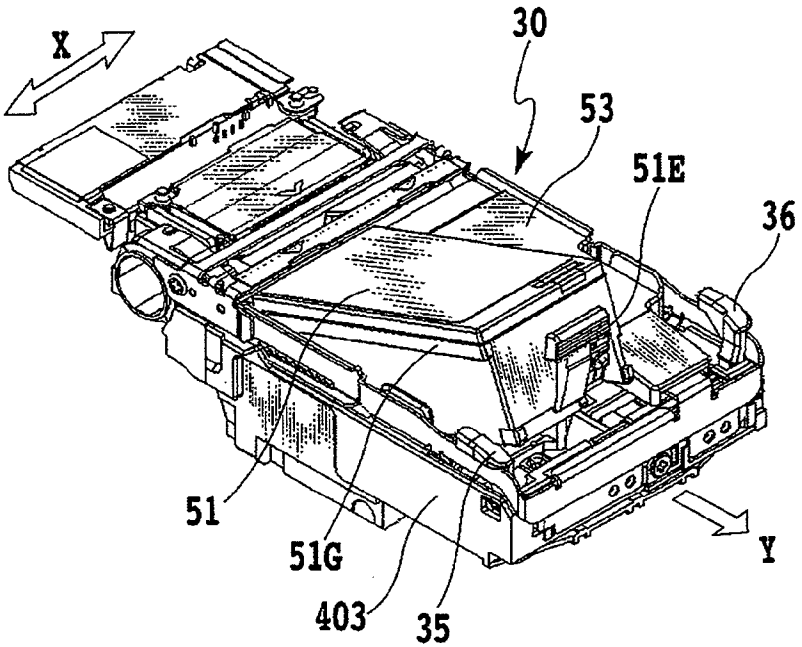
FIG. 9A and FIG. 9B are explanatory drawings of a mounting work of the ink tank with respect to the head cartridge mounted on the carriage in FIG. 3, respectively.
Figure 9A:
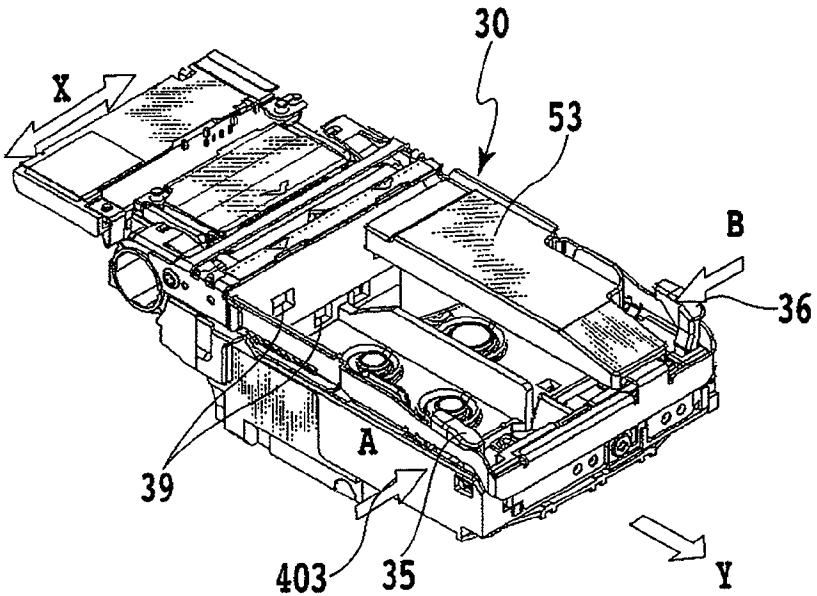
Figure 11:
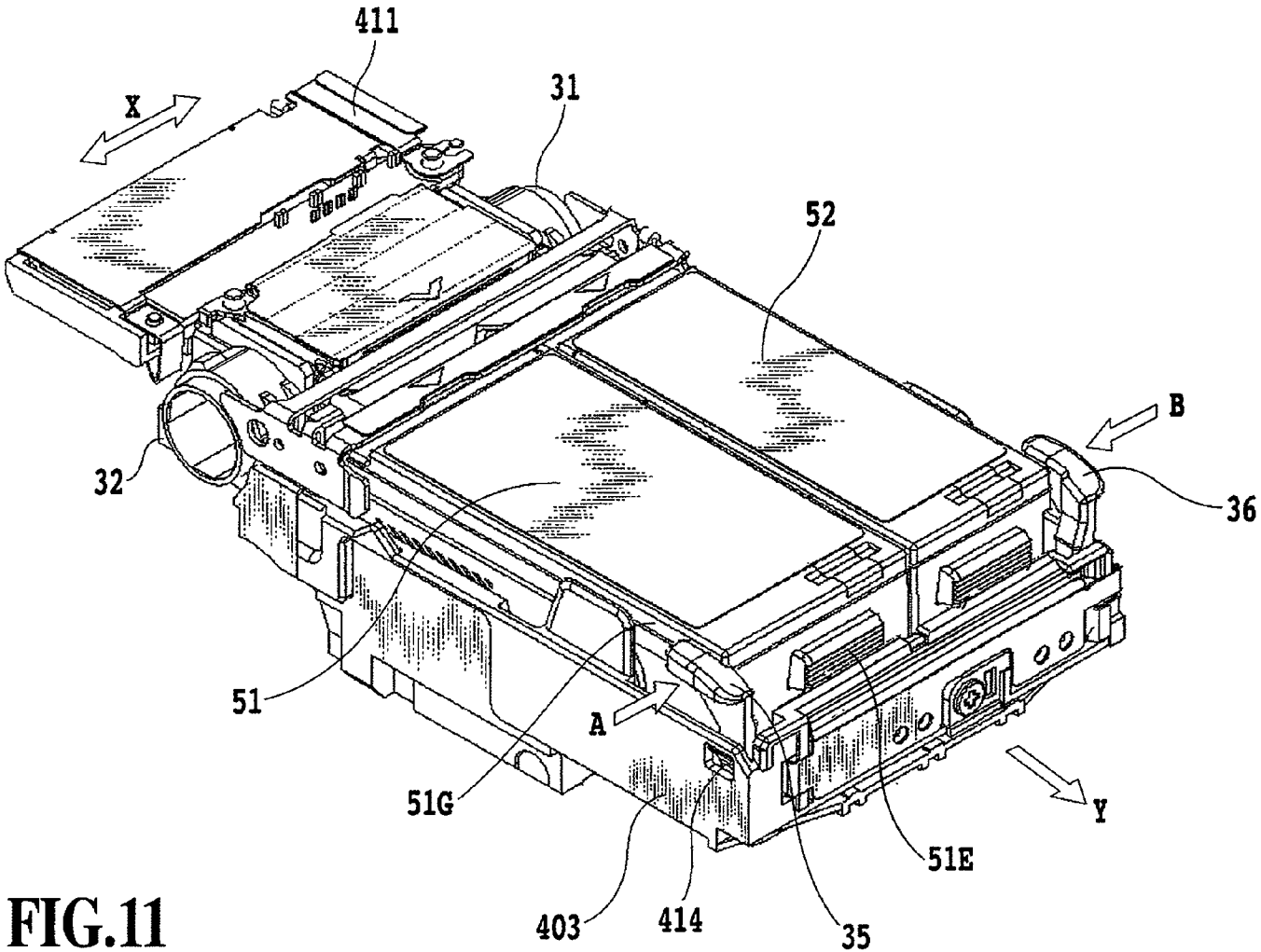
FIG. 11 is a perspective view when the two ink tanks are mounted on the carriage in FIG. 10.

When attaching the ink tank 51, first, as shown in FIG. 9B, the retaining claw (not shown) formed on the ink tank 51 is engaged with the retaining hole 39 (refer to FIG. 8B) of the head cartridge 30 side. After that, as shown in FIG. 2, the latch claw 51F of the latch lever 51E of the ink tank 51 is engaged with the engaging hole 40 (refer to FIG. 10) of the head cartridge 30 side. This allows the ink tank 51 to be attached to the head cartridge 30. As shown in FIG. 11, the ink tank 52 can be attached in the same manner.

(Operation of Removing the Ink Tank)

When removing the ink tank 51, after having released the engagement between the latch claw 51F and the engaging hole 40 (refer to FIG. 10) of the head cartridge 30 side by pressing the latch lever 51E, the latch lever 51E is pressed upward. The ink tank 52 can be removed in the same manner.

(Fixing Structure of the Guide Shaft)

For the guide shaft 401 in the present example, a hollow (pipe) shaft of a plate thickness of 1 mm in place of a solid shaft is used with the aim of reducing the printing apparatus in weight. At both ends of the hollow guide shaft 401, grooves of a depth of 0.5 mm are formed along its circumferential direction.

Figure 12B:
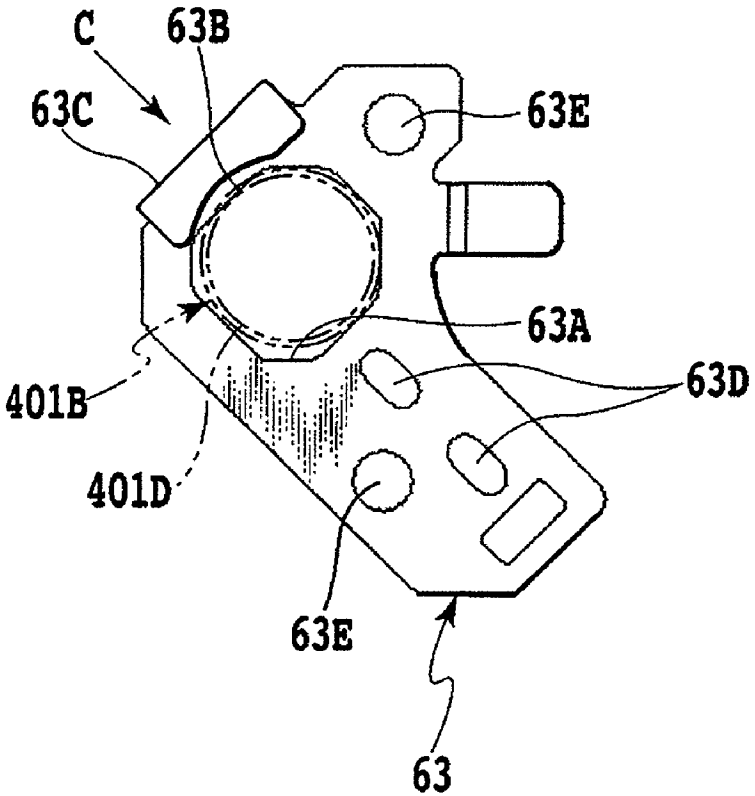
FIG. 12A and FIG. 12B are top views of a plate used for fixing one end and the other end of a guide shaft in FIG. 3.
Figure 12A:
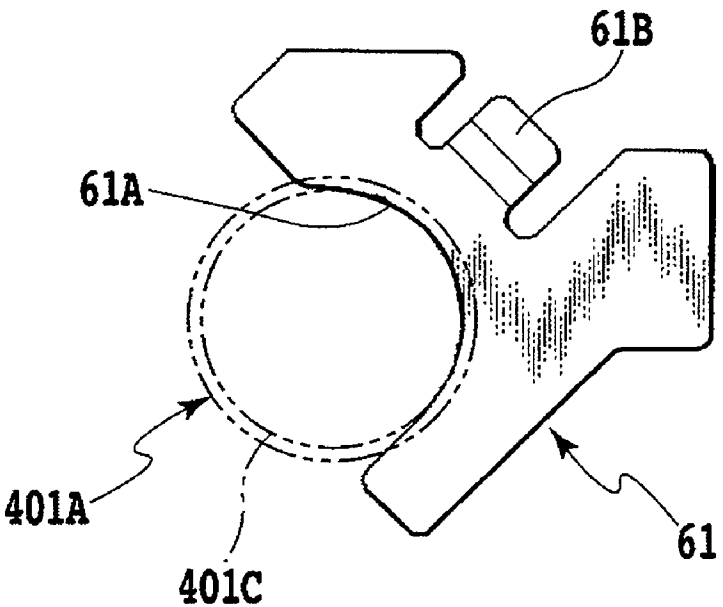
Figure 13:
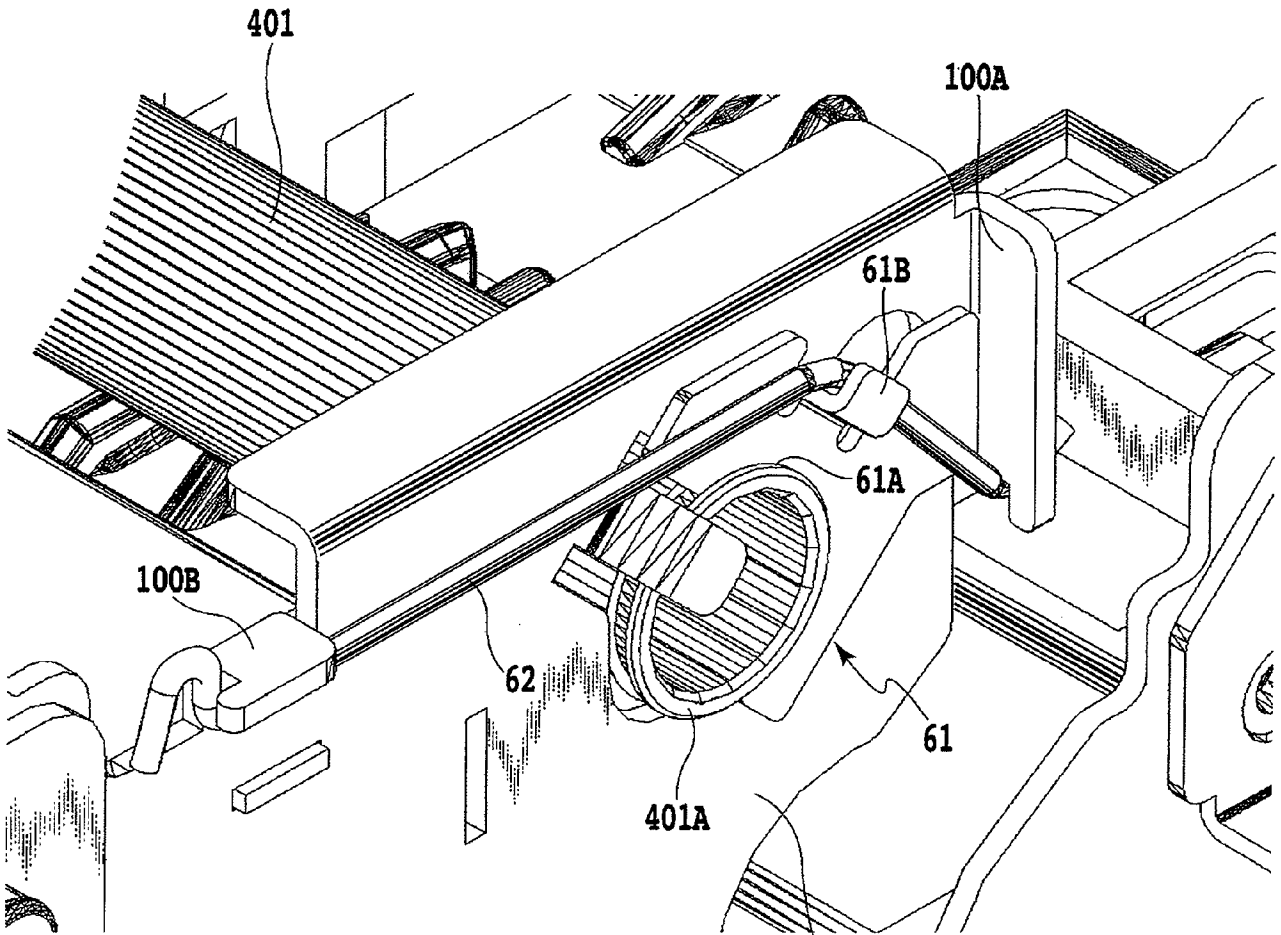
FIG. 13 is a perspective view of a fixing portion of the left end of the guide shaft in FIG. 3.
Figure 14:
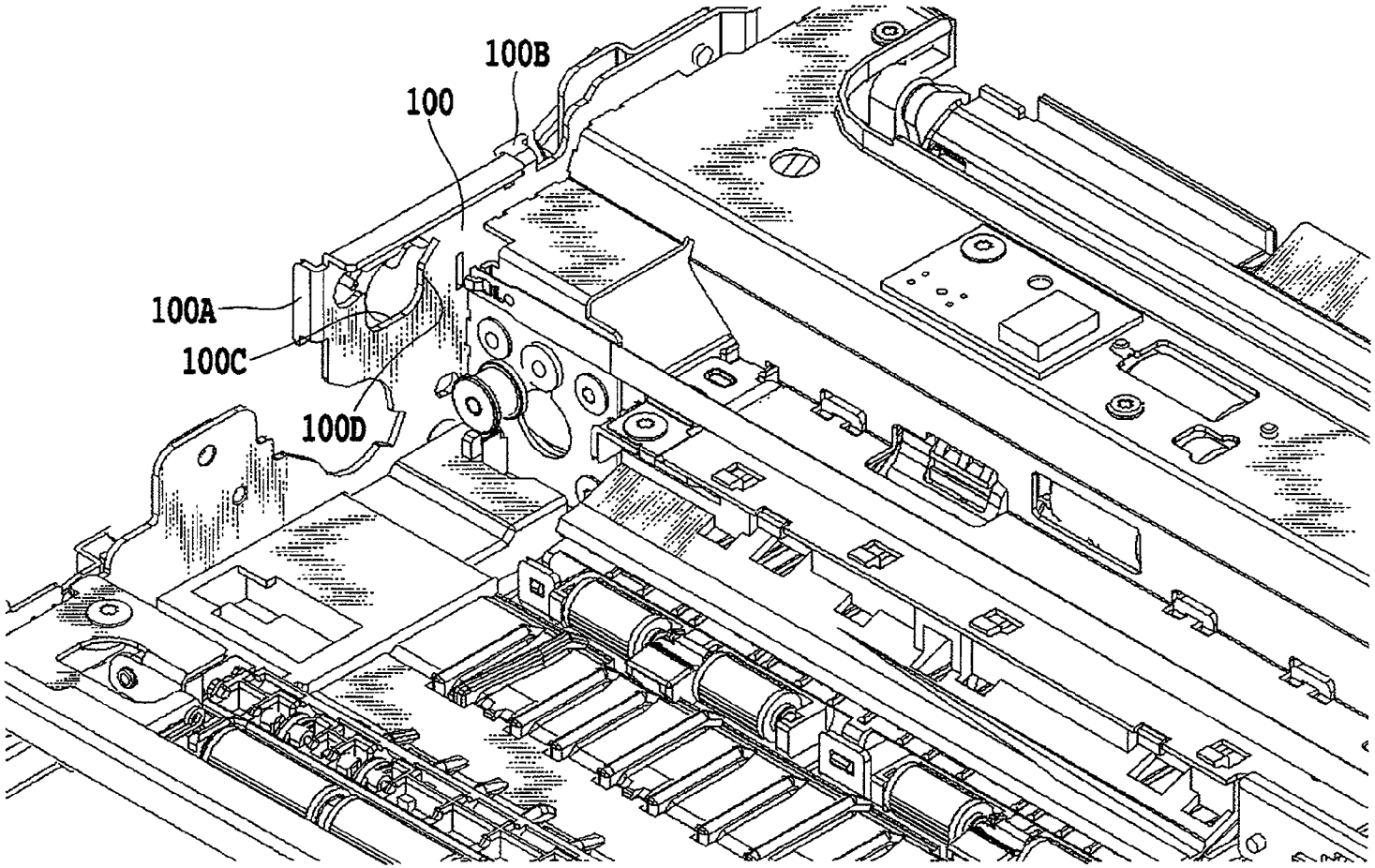
FIG. 14 is a perspective view of a chassis portion to which the left end of the guide shaft in FIG. 3 is fixed.

The left end 401A of the guide shaft 401 is fixed to the chassis 100 by using a plate 61 shown in FIG. 12A. In the plate 61, an arc portion 61A and a folding portion 61B are formed. As shown in FIG. 12A, the arc portion 61A is insertable inside a groove 401C of a depth of 0.5 mm formed at the left end 401A of the guide shaft 401. And, in a part of the chassis 100 with the guide shaft 401 fixed, folding portions 100A, 100B as shown in FIG. 13 and reference surface portions 100C, 100D as shown in FIG. 14 are formed. The reference surface portions 100C, 100D are fittable in the groove 401C of the guide shaft 401.

When fixing the left end 401A of the guide shaft 401, as shown in FIG. 13, the arc portion 61A of the plate 61 is inserted inside the groove 401C, and then a middle portion and both ends of a shaft spring 62 are hooked to the folding portions 61B, 100A, and 100B, respectively. This allows the groove 401C to be sandwiched between the reference surfaces 100C, 100D and the arc portion 61A, and the left end 401A of the guide shaft 401 is fixed.

On the other hand, the right end 401B of the guide shaft 401 is fixed to the chassis 100 by using a plate 63 shown in FIG. 12B. In the plate 63, a hole portion 63A passing through the right end 401B of the guide shaft 401 with a sufficient margin is formed, and a inserting surface portion 63B is formed in a part of the hole portion 63A. The inserting surface portion 63B is insertable inside the groove 401D of the depth of 0.5 mm formed in the right end 401B of the guide shaft 401. And, in the plate 63, an operation portion 63C for pressing the plate 63 in the arrow C direction, guide grooves 63D extending in the arrow C direction, and bolt inserting holes 63E for passing through bolts 64 mentioned later are formed. Furthermore, in the part of the chassis 100 with the right end 401B of the guide shaft 401 fixed, guide projections 100E (refer to FIG. 15) located inside the guide grooves 63D, nut portions 100F (refer to FIG. 16) engaged with the bolts 64 are screwed and fitted, and reference surface portions 100G, 100H are formed. The reference surface portions 100G, 100H are fittable in the groove 401D of the guide shaft 401.

Figure 15:
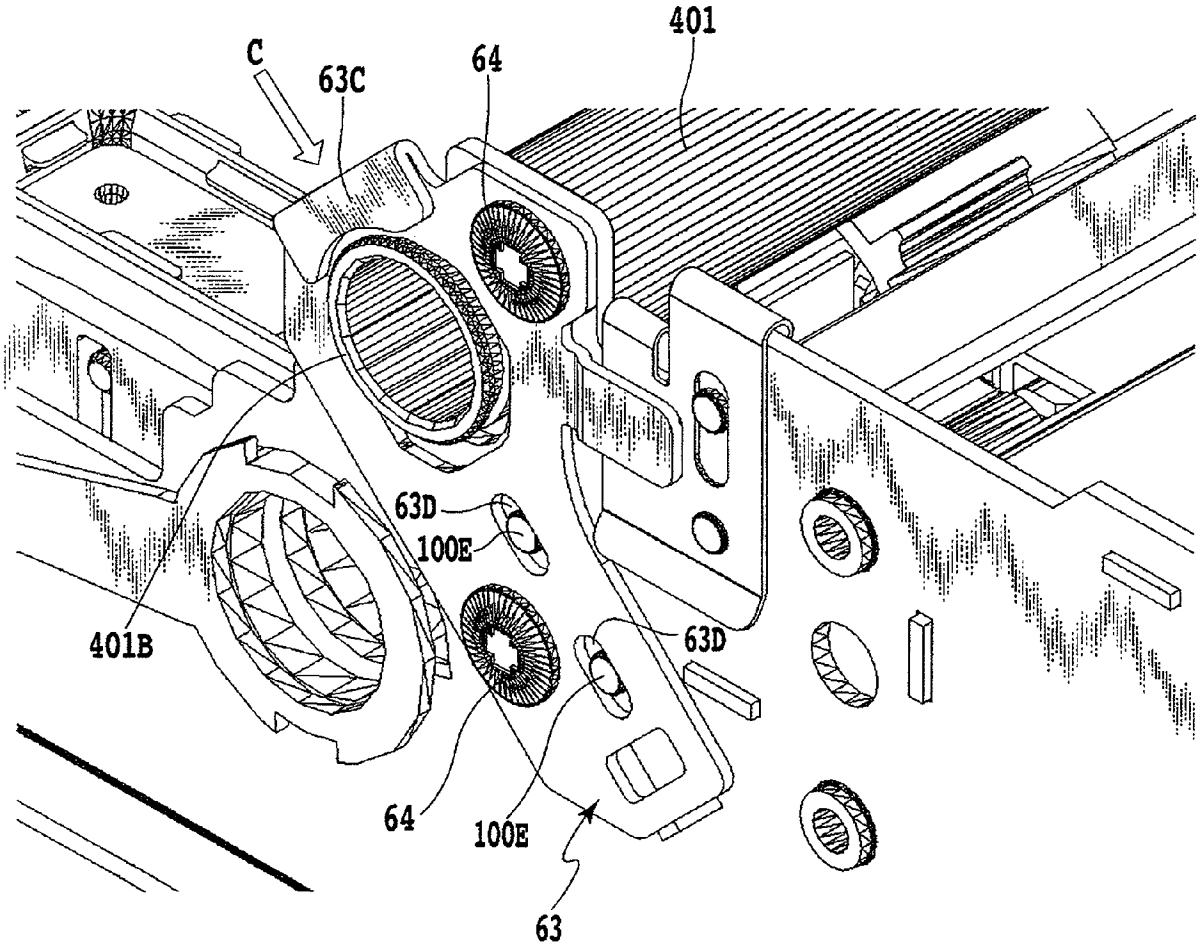
FIG. 15 is a perspective view of a fixing portion of the right end of the guide shaft in FIG. 3.
Figure 16:
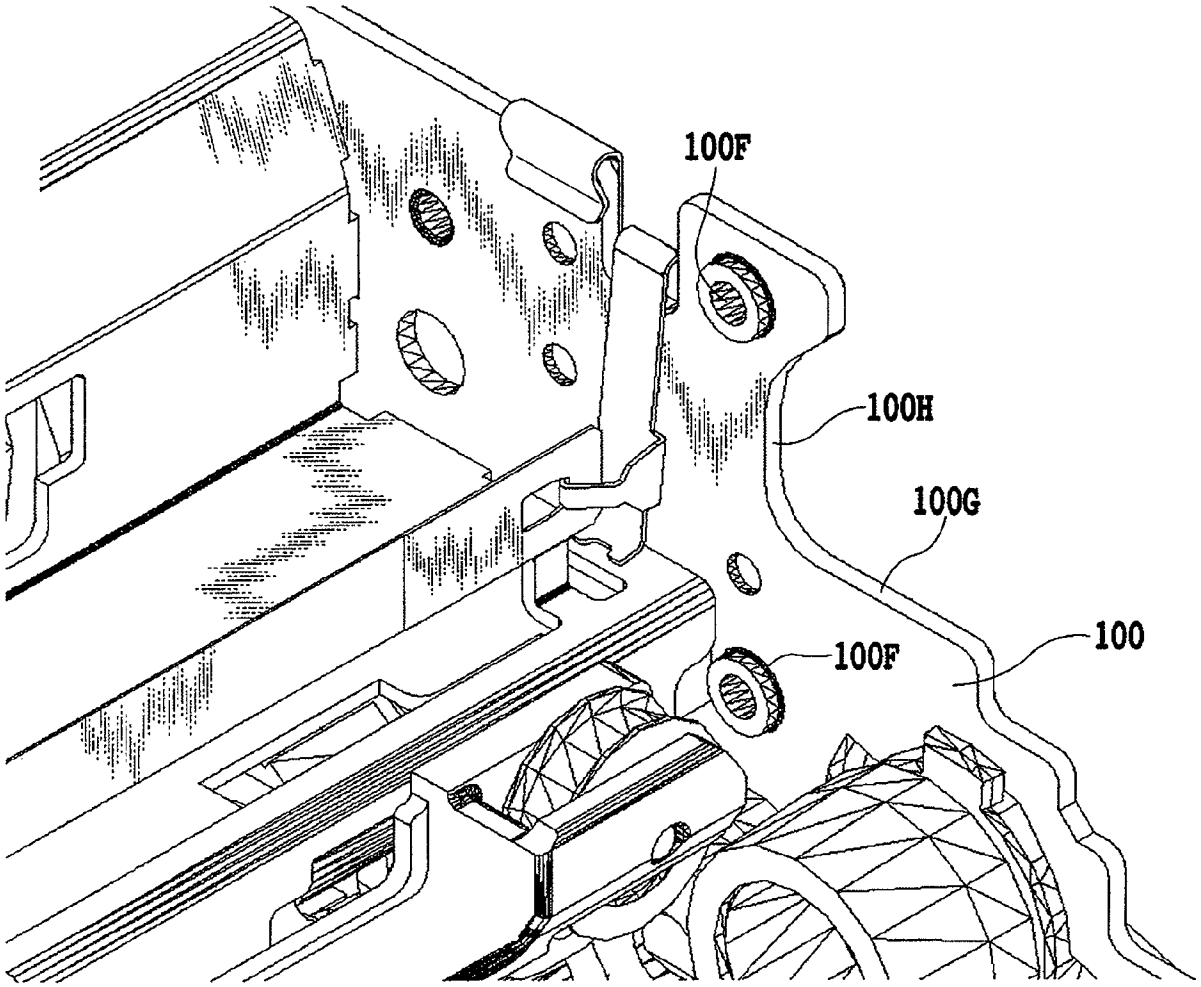
FIG. 16 is a perspective view of a chassis portion to which the right end of the guide shaft in FIG. 3 is fixed.

When fixing the right end 401B of the guide shaft 401, as shown in FIG. 15, the guide projections 100E are inserted inside the guide grooves 63D of the plate 63, and the inserting surface portion 63B is inserted inside the groove 401C. Furthermore, through bolt inserting holes 63E of the plate 63, the bolts 64 are screwed to the nut portions 100F. And, while pressing the operation portion 63 in the arrow C direction, by tightening the bolts 64, the groove 401D is sandwiched between the reference surface portions 100G, 100H and the inserting surface portion 63B, and then the right end 401B of the guide shaft 401 is fixed.

A fixing structure of the right end 401B of the guide shaft 401 like this has an advantage in the case where a space that can be secured at a right side of the chassis 100 is small.

(Bearing Portion of the Carriage)

Figure 17B:
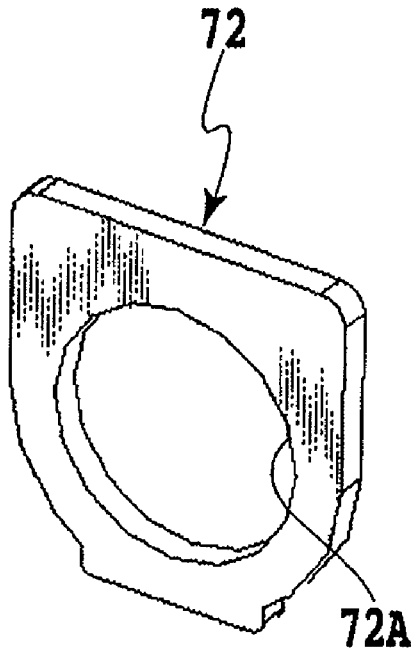
FIG. 17A and FIG. 17B are perspective views of a guide member and an oil pad which are attached to the carriage in FIGS. 3.
Figure 17A:
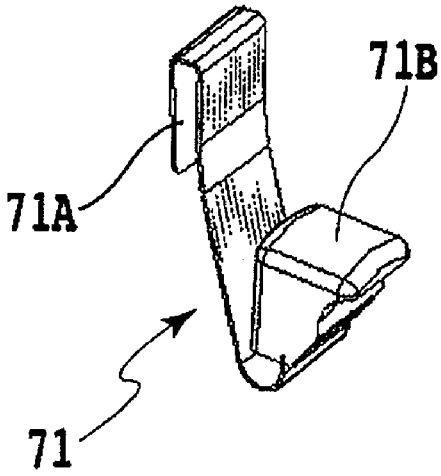
Figure 18:
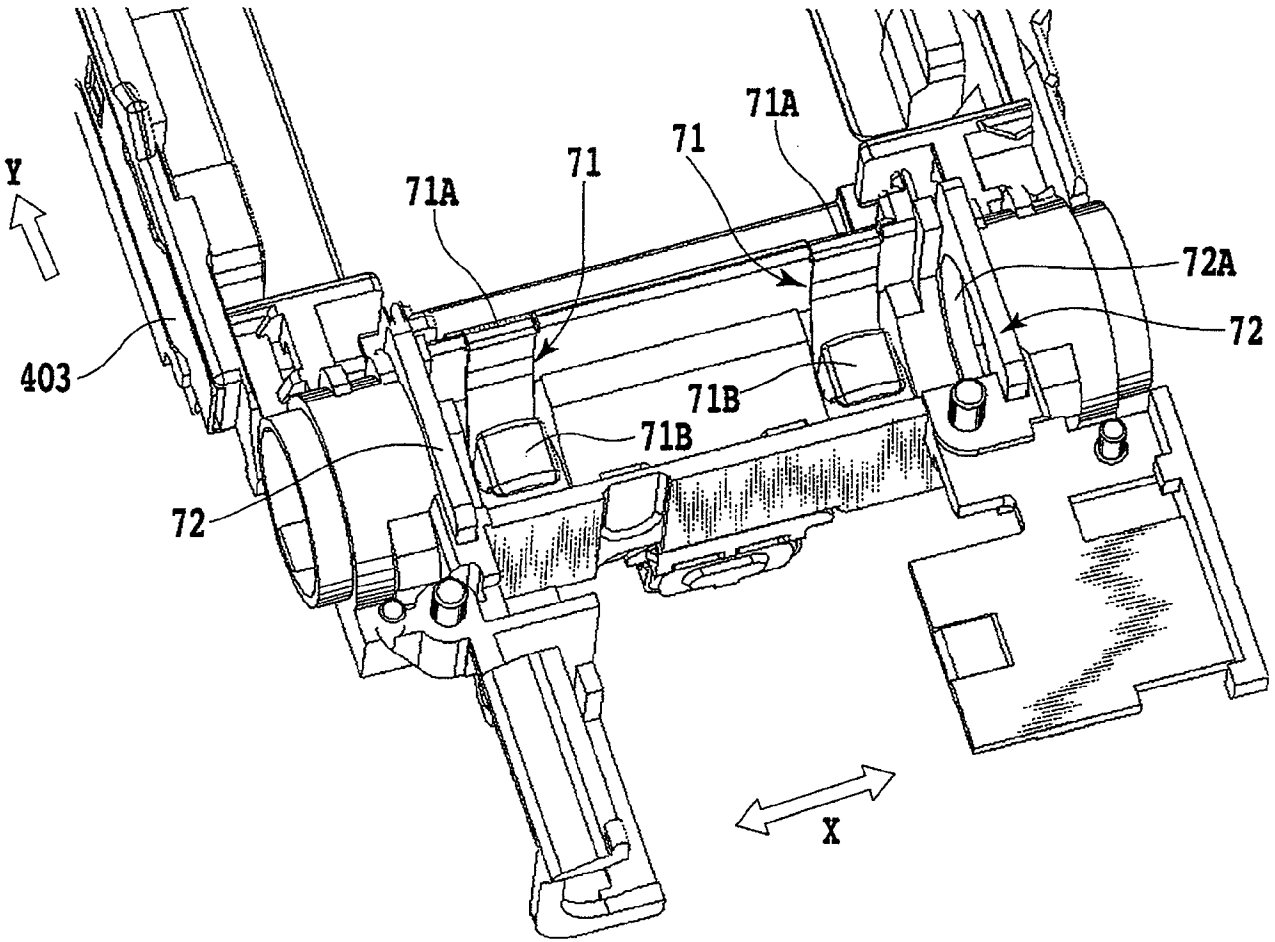
FIG. 18 is a perspective view of a bearing portion of the carriage to which the guide member in FIG. 17A and the oil pad in FIG. 17B are attached.

In the present example, right/left bearing portions of the carriage 403 which are fitted to be slidable in the shaft 401 are equipped with a guide member 71 as shown in FIG. 17A and an oil pad 72 as shown in FIG. 17B. The guide member 71 is constructed to provide a slider 71B at a tip of the spring 71A. The guide member 71 is attached to the carriage 403 as shown in FIG. 18, and the slider 71B is held at a location contacting with an outer surface of the guide shaft 401 in such a manner that a base end of the spring 71A is attached to be inserted in the vicinity of the right/left bearing portions of the carriage 403. And, the oil pad 72 containing oil is attached to the right/left bearing portions of the carriage 403 as shown in FIG. 18, and positioned so that an inner circumferential surface of its circle hole 72A may contact with an outer circumferential surface of the guide shaft 401.

Other Embodiments

When a head cartridge is mounted on a carriage, pressure contact means for connecting those electrical connecting portions by pressure are not specified in only a construction using a set lever, but may be a construction capable of exhibiting a function as the pressure contact means.

Locking means in which the head cartridge is fixed to the carriage when the head cartridge has been mounted on the carriage, and a fixation of the head cartridge is released by receiving a releasing operation are not specified in only the construction using the set lever.

And, obstructing means for obstructing the releasing operation of the locking means may be any construction capable of obstructing the releasing operation of the locking means when mounting the ink tank, therefore, except for the construction using the ink tank like the embodiment mentioned above, a member working together with a mounting of the ink tank can be used.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2006-227183, filed Aug. 23, 2006, which is hereby incorporated by reference herein in its entirety.

What is claimed is:

1. An ink jet printing apparatus constructed to print an image on a printing medium with a movement of a carriage on which a head cartridge is detachably mounted, wherein the head cartridge has an ink tank replaceably mounted thereon and is equipped with a printing head for ejection of ink supplied from the ink tank, the ink jet printing apparatus comprising:

a carriage side connecting portion, which is provided in the carriage, forming a transmission route of a control signal of the printing head, and being connected by pressure contact with a head cartridge side connecting portion provided in the head cartridge;

a pressure contact means for connecting the head cartridge side connecting portion and the carriage side connecting portion by pressure contact when the head cartridge is mounted on the carriage;

a locking member movable between a first position in which the head cartridge is fixed to the carriage and a second position in which the head cartridge is detachably mounted on the carriage, wherein the locking member is prevented from moving to the second position from the first position by the ink tank when the ink tank is mounted on the head cartridge, and is not prevented from moving to the second position from the first position when the ink tank is not mounted on the head cartridge.

2. An ink jet printing apparatus according to claim 1, wherein when the head cartridge is mounted on the carriage, the pressure contact member presses the head cartridge in a direction for connection of the head cartridge side connecting portion with the carriage side connecting portion.

3. An ink jet printing apparatus according to claim 1, wherein the carriage side connecting portion is provided in the carriage via an elastic substance.

4. An ink jet printing apparatus according to claim 1, wherein the carriage side connecting portion is a card edge connector.

5. An ink jet printing apparatus according to claim 1, further comprising a pop-up spring portion for moving the locking member to the second position from the first position.

6. An ink jet printing apparatus according to claim 1, wherein the locking member includes a claw for releaseable engagement with the carriage, and wherein when the ink tank is mounted on the head carriage the ink tank prevents release of the engagement of the claw from the carriage.

7. An ink jet printing apparatus constructed to print an image on a printing medium with a movement of a carriage on which a head cartridge is detachably mounted, wherein the head cartridge has an ink tank replaceably mounted thereon and is equipped with a printing head for ejection of ink supplied from the ink tank, the ink jet printing apparatus comprising:

a locking member movable between a first position in which the head cartridge is fixed to the carriage and a second position in which the head cartridge is detachably mounted on the carriage, wherein the locking member is prevented from moving to the second position from the first position by the ink tank when the ink tank is mounted on the head cartridge, and is not prevented from moving to the second position from the first position when the ink tank is not mounted on the head cartridge.

8. An ink jet printing apparatus according to claim 7, further comprising a pop-up spring portion for moving the locking member to the second position from the first position.

9. An ink jet printing apparatus according to claim 7, wherein the locking member includes a claw for releaseable engagement with the carriage, and wherein when the ink tank is mounted on the head carriage the ink tank prevents release of the engagement of the claw from the carriage.

* * * * *